US010750860B1

(12) United States Patent
Arndt

(10) Patent No.: US 10,750,860 B1
(45) Date of Patent: Aug. 25, 2020

(54) TOY GUN SAFE

(71) Applicant: Emily Arndt, Lakewood, CO (US)

(72) Inventor: Emily Arndt, Lakewood, CO (US)

( * ) Notice: Subject to any disclaimer, the term of this patent is extended or adjusted under 35 U.S.C. 154(b) by 0 days.

(21) Appl. No.: 16/666,403

(22) Filed: Oct. 29, 2019

(51) Int. Cl.
*A47B 81/00* (2006.01)
*E05G 1/00* (2006.01)

(52) U.S. Cl.
CPC ..... *A47B 81/005* (2013.01); *E05G 1/00* (2013.01)

(58) Field of Classification Search
CPC .... E05G 1/00; E05G 1/04; E05G 1/06; E05G 1/10; E05G 1/024; E05G 1/026; E05G 2700/00; A47B 81/00; A47B 81/005; E05B 65/0075
USPC ..... 211/64; 109/58, 59 R, 64; 42/70.01, 42/70.11; 312/321.5
See application file for complete search history.

(56) References Cited

U.S. PATENT DOCUMENTS 342,003 A * 5/1886 Gross ..... E05G 1/00 109/62
492,304 A * 2/1893 Markle ..... A47F 3/10 312/135
712,428 A * 10/1902 Whitcomb ..... A47B 81/005 211/64
750,817 A * 2/1904 Creenshaw ..... F41C 33/06 206/317
1,442,732 A * 1/1923 Ohnstrand ..... E05G 1/005 109/79
1,654,616 A * 1/1928 Spann ..... A47B 81/005 312/204
D99,074 S * 3/1936 Eastman ..... D6/552
D126,088 S * 3/1941 Clouse ..... D6/657
2,233,699 A * 3/1941 Gorrell ..... E05B 65/0014 292/227
2,797,033 A * 6/1957 Rasbach ..... A47B 81/005 224/275
D185,600 S * 6/1959 Gaither ..... D21/519
2,939,587 A * 6/1960 Kondziolka ..... A47B 81/005 211/64
3,031,069 A * 4/1962 Hirsch ..... F41C 33/06 206/317
3,078,133 A * 2/1963 Schauer ..... A47B 46/00 312/321.5
3,167,182 A * 1/1965 Calvin ..... B60R 7/14 211/64
3,369,721 A * 2/1968 Lentz ..... F41C 33/06 206/317
3,720,013 A * 3/1973 McDonald ..... F41C 33/0209 42/106
4,796,762 A * 1/1989 Law ..... A47B 81/005 211/117
4,986,427 A * 1/1991 Law ..... A47B 81/005 211/117
5,094,483 A * 3/1992 James ..... E05B 65/0075 109/59 R (Continued)

*Primary Examiner* — Jonathan Liu
*Assistant Examiner* — Devin K Barnett

(57) ABSTRACT

An illustrated view of an exemplary toy gun safe for teaching care for guns for children is presented. The toy gun safe is useful for children that like to collect play guns and ammunition. The toy gun safe is useful for teaching kids at a young age several different things including gun safety and organizing skills for toy guns and gun accessories. Each toy gun safe further has a gun safety booklet written in a child's vocabulary that teaches gun safety that a parent can read the child.

15 Claims, 4 Drawing Sheets

(56) References Cited

U.S. PATENT DOCUMENTS 5,145,245 A * 9/1992 Fierthaler ..... A47B 46/00 312/321.5
5,579,909 A * 12/1996 Deal ..... A47B 81/005 206/1.5
5,701,770 A * 12/1997 Cook ..... E05B 47/02 206/1.5
5,758,933 A * 6/1998 Clendening ..... A47B 81/00 206/315.11
5,957,308 A * 9/1999 Zierenberg ..... A47B 81/005 211/118
6,042,207 A * 3/2000 Crosby ..... A47B 81/005 211/153
6,260,300 B1 * 7/2001 Klebes ..... F41A 17/066 206/317
6,488,148 B1 * 12/2002 Woodson ..... B65D 25/10 206/1.5
D488,300 S * 4/2004 Lopez ..... D3/319
7,478,892 B2 * 1/2009 Punzel ..... E05C 9/043 312/322
D617,525 S * 6/2010 Taylor ..... D99/28
7,735,253 B2 * 6/2010 Giebel ..... A47B 81/00 42/70.11
9,198,512 B1 * 12/2015 Moayeri ..... A47B 81/005
2004/0045914 A1 * 3/2004 Sells ..... A47B 49/00 211/4
2004/0130250 A1 * 7/2004 Cleveland ..... A47B 81/005 312/409
2004/0140235 A1 * 7/2004 Cleveland ..... A47B 81/005 206/315.11
2004/0140280 A1 * 7/2004 Cleveland ..... A47B 46/00 211/64
2005/0082241 A1 * 4/2005 Lane ..... A47B 81/005 211/64
2005/0115912 A1 * 6/2005 Szuminski ..... A47B 81/005 211/64
2005/0133473 A1 * 6/2005 Lesperance ..... A47B 81/005 211/64
2006/0283820 A1 * 12/2006 Peters ..... A47B 81/005 211/64
2007/0013478 A1 * 1/2007 Crigger ..... A47B 81/005 340/5.53
2007/0277712 A1 * 12/2007 Stepp ..... A47B 81/005 109/50
2009/0078661 A1 * 3/2009 Kinsella ..... A47B 81/005 211/64
2010/0064949 A1 * 3/2010 Luling ..... E05G 1/005 109/76
2011/0083591 A1 * 4/2011 Stepp ..... E05B 65/0075 109/64
2011/0174199 A1 * 7/2011 Pendleton ..... E05B 17/2038 109/59 R
2011/0175730 A1 * 7/2011 Stevenson ..... E05B 63/0065 340/540
2012/0086318 A1 * 4/2012 Tassin ..... A47B 46/00 312/249.7
2012/0092281 A1 * 4/2012 Gilbertson ..... G07C 9/0069 345/173
2012/0223626 A1 * 9/2012 Thomas ..... E06B 7/34 312/242
2012/0261287 A1 * 10/2012 Perkins ..... F41B 5/1457 206/317
2013/0019784 A1 * 1/2013 Yang ..... E05B 47/026 109/59 R
2014/0027394 A1 * 1/2014 Stepp ..... A47B 81/005 211/64
2014/0132131 A1 * 5/2014 Thomas ..... A45C 11/16 312/204
2014/0284232 A1 * 9/2014 Feris ..... F41C 33/06 206/317
2014/0345507 A1 * 11/2014 Pendleton ..... A47B 81/005 109/48
2015/0101516 A1 * 4/2015 Suggs ..... A47B 81/005 109/64
2015/0332528 A1 * 11/2015 McGinnis ..... E05B 65/0075 109/38
2016/0040471 A1 * 2/2016 Smietana ..... E05G 1/04 340/5.31
2016/0053526 A1 * 2/2016 Dittrich ..... E05G 1/04 109/38
2016/0060906 A1 * 3/2016 Stein ..... E05B 65/0082 292/138
2016/0060918 A1 * 3/2016 Garrett ..... E05C 5/04 109/64
2016/0095432 A1 * 4/2016 Wirthlin ..... F41C 33/06 312/321.5
2016/0108644 A1 * 4/2016 Igarashi ..... E05C 9/10 109/64
2016/0186465 A1 * 6/2016 Nelson ..... E05B 17/10 220/210
2018/0058133 A1 * 3/2018 Kay ..... E05G 1/024
2019/0055772 A1 * 2/2019 Penland ..... E05G 1/10
2019/0063871 A1 * 2/2019 Cain ..... F41C 33/06
2019/0110952 A1 * 4/2019 Wallace ..... B65F 1/1426
2019/0360259 A1 * 11/2019 Green ..... E05G 1/10

* cited by examiner

TOY GUN SAFE

FIELD OF THE INVENTION

This invention relates to gun safes. More particularly, it relates to a toy version of a gun safe.

BACKGROUND

A gun safe is a safe for one or more firearms and/or ammunition for those guns. Gun safes are primarily used to prevent access to unauthorized or unqualified persons, for burglary protection, and, in more capable safes, to protect the contents from damage during a flood, fire, or natural disaster. Access prevention is required by law in many places, necessitating a gun lock, metal gun cabinet, or gun safe. Gun safes have largely replaced the gun cabinets made of fine stained wood with etched glass fronts used for display that were commonly used decades ago, although some gun safes are made to resemble such gun cabinets.

Gun safes may include additional security features such as fire or water protection, combination lock, digital lock, and fingerprint identification.

Electronic locks as well as mechanical locks are available on many models of safes. The highest reliability exists for mechanical locks, although they are often more time consuming to open than electronic locks. Some mechanical combination locks have key locks, too, that lock the combination lock dial from turning, thereby precluding casual attempts by anyone with physical access to the safe from trying multiple combinations in the hopes of unlocking the safe.

Some safes use live locking bolt technology and pry resistant metal to ensure the secure protection of its contents against forced entry. Some safes provide only protection against smash and grab burglary and unwanted access from young family members at home or outside, while other safes provide additional protection against fire and flood and other natural disasters.

Vault doors are available for creating walk-in gun safes or vaults in a dedicated room or gun armory in one's home. Such rooms are also sometimes used as a dual-use gun safe or panic room, or even as a dedicated shelter for use in the case of a tornado or hurricane.

Gun safes with a carved wood exterior (furniture safes) serve a primarily decorative purpose and resemble old gun cabinets used for displaying weapons in the past. Design characteristics may include wood veneer and very thick tempered glass.

Some gun safes are designed to be hidden from obvious view. False walls with hinges located at one end of closets are also sometimes used to hide gun safes, although simply installing a gun safe in an existing closet with a door that closes can achieve much of the same advantages to prevent intruders from becoming aware of the existence of a gun safe.

Depending on a place where the gun will be stored, different types of gun safes appeared: under the bed and bedside, in-wall, vehicle, cabinets, drawers, mirror, and nightstand. Every gun safe requires a dehumidifier to prevent rust.

Gun owners often desire to teach their children proper safety of guns. That allows for the children to grow up respecting guns and understanding of the care necessary for guns. Often the children are given toy guns thereby having a toy to mimic their parents when using guns. Proper storage is important to keep a gun clean and in condition for firing without misfire. Currently, children store their toy guns in toy boxes, in their closet, laying on a floor, etc. while the parents are storing their guns and gun accessories in gun safes.

In light of the foregoing, there is a need for a gun safe that can be used as a toy for teaching children proper care of guns while growing up.

DETAILED DESCRIPTION

Figure 1:
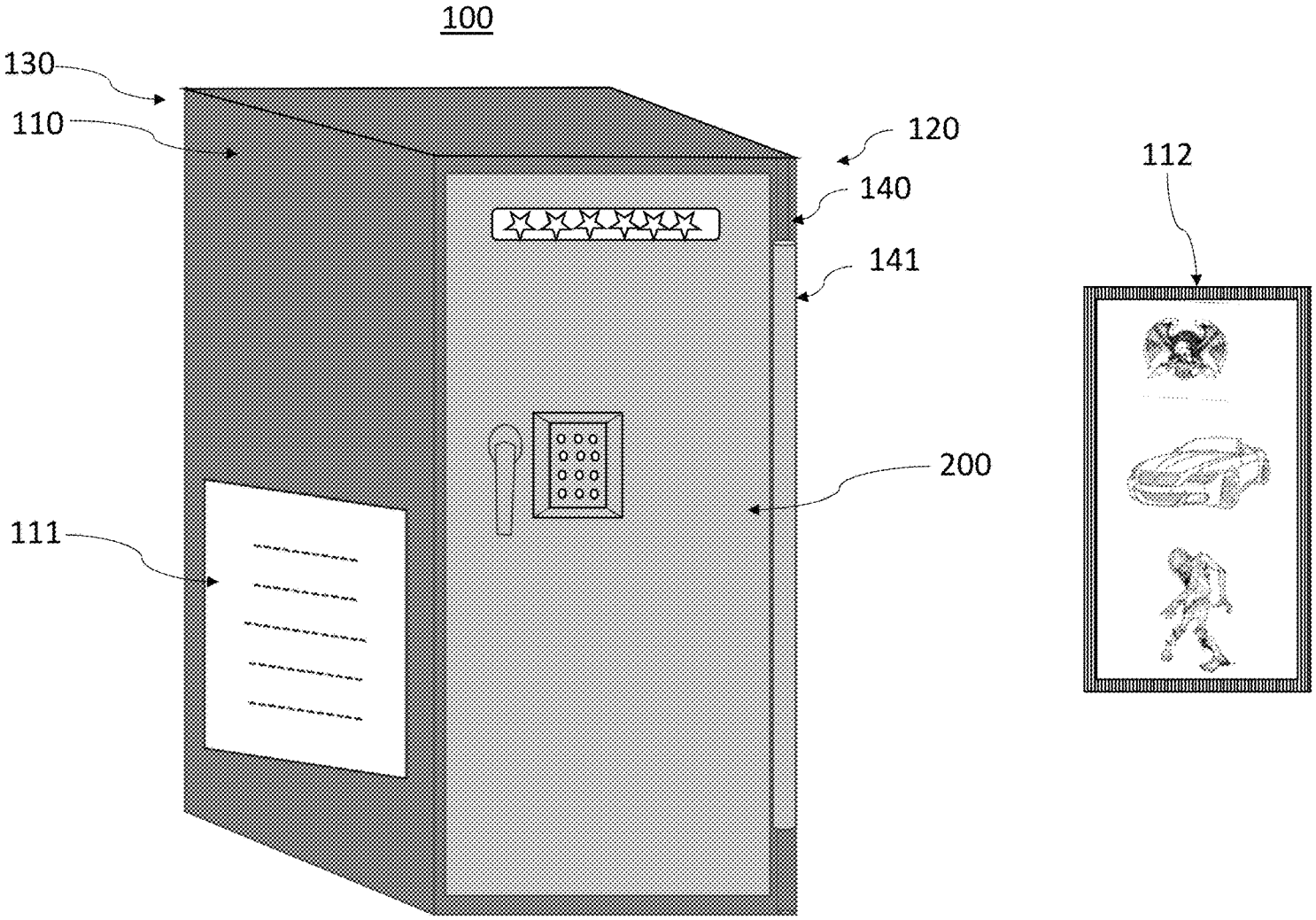
FIG. 1 is an illustrated view of an exemplary toy gun safe.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of an exemplary toy gun safe 100 for teaching care for guns for children is presented. The toy gun safe 100 is useful for children that like to collect play guns and ammunition. The toy gun safe 100 is useful for teaching kids at a young age several different things including gun safety and organizing skills for toy guns and gun accessories.

The toy gun safe 100 is preferably made of a hard-plastic material, however other materials are hereby contemplated, including, but not limited to, steel aluminum, wood, polyvinyl chloride (PVC), etc. The toy gun safe 100 is preferably a color of one of: pink camo, regular camo, neon oranges, neon blues and neon purples, however the toy gun safe 100 may be any other color as desired. The toy gun safe 100 preferably has a height of forty-eight (48) inches, however other heights are hereby contemplated, including, but not limited to, forty (40) inches, fifty-four (54) inches, etc. The toy gun safe 100 preferably has a depth of twenty-four (24) inches, however other depths are hereby contemplated, including, but not limited to, twenty (20) inches, thirty-six

(36) inches, etc. The toy gun safe 100 preferably has a width of twenty-four (24) inches, however other widths are hereby contemplated, including, but not limited to, twenty (20) inches, thirty-six (36) inches, etc.

The toy gun safe 100 has a first side wall 110, a second side wall 120, a back wall 130, a front 140 and a front door 200. The front door 200 will be described in detail in FIG. 2A and FIG. 2B.

The first side wall 110 has a first sticker 111 and a book of second stickers 112. The first sticker 111 is preferably a gun safety rules sticker put in child's vocabulary, such as Always keep your firearm pointed in a safe direction, Treat all firearms as if they are loaded, Keep your trigger finger outside of the guard and off of the trigger until you are ready to fire, Be certain of your target, your line of fire and what lies beyond the target, etc. The first sticker 111 is pre-stuck to the first side wall 110 and the second side wall 120. The book of second stickers 112 is optionally removably adhered to any part of the toy gun safe 100. The book of second stickers 112 has one or more of: an animal sticker, targets, zombies, cars, flowers, American flag, a page of sayings such as Battle, No Trespassing, Gun Safety, Handle with Care, Danger, Bulletproof, Fearless, etc. The targets of the book of second stickers 112 can be used coupled to the toy gun safe 100 or as a item to shoot at with their guns for target practice.

The front door 200 is hingedly coupled to the front 140 of the toy gun safe 100 by a hinge 141. The front door 200 is useful in allowing access to an inside 300 of the toy gun safe 100 which will be shown in detail in FIG. 2B.

Figure 2A:
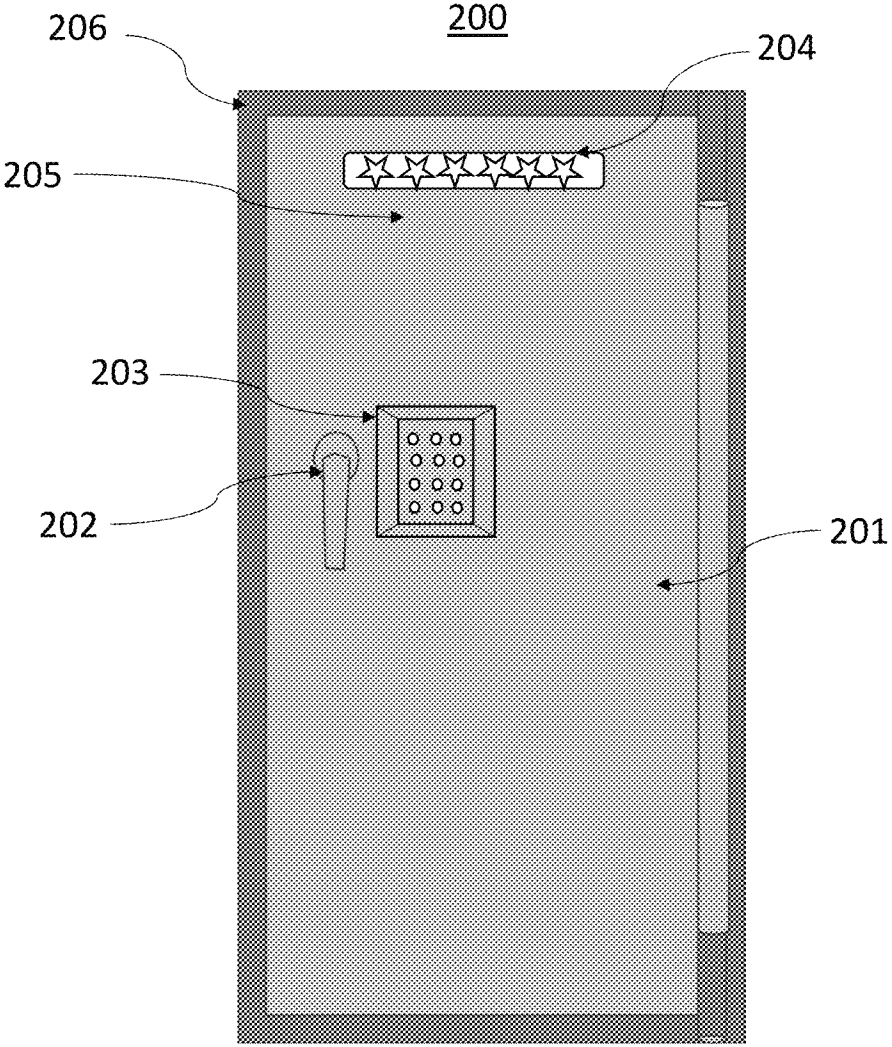
FIG. 2A is an illustrated view of an exterior of a front door of the toy gun safe shown in FIG. 1.

Moving now to FIG. 2A, an exterior 201 of the front door 200 of the toy gun safe 100 is presented. The exterior 201 of the front door 200 has a handle 202 and a passcode box 203. The passcode box 203 is useful for locking the toy gun safe 100 when the toy gun safe 100 is not being accessed. The passcode box 200 is preferably substantially near the handle on the front door 200 of the toy gun safe 100. The handle 202 is useful for opening and closing of the front door 200 to allow access and to prevent others from entering the toy gun safe 100.

The front door 200 of the toy gun safe 100 further has a light 204. Light 204 is removably and securely coupled to a middle 205 of a top 206 of the front door 200 The light 204 is preferably light emitting diodes (LED) lamps, however other types of lamps are hereby contemplated, including, but not limited to, liquid crystal display (LCD), fluorescent, etc. The light 204 is powered by a power source such as a rechargeable battery.

Figure 2B:
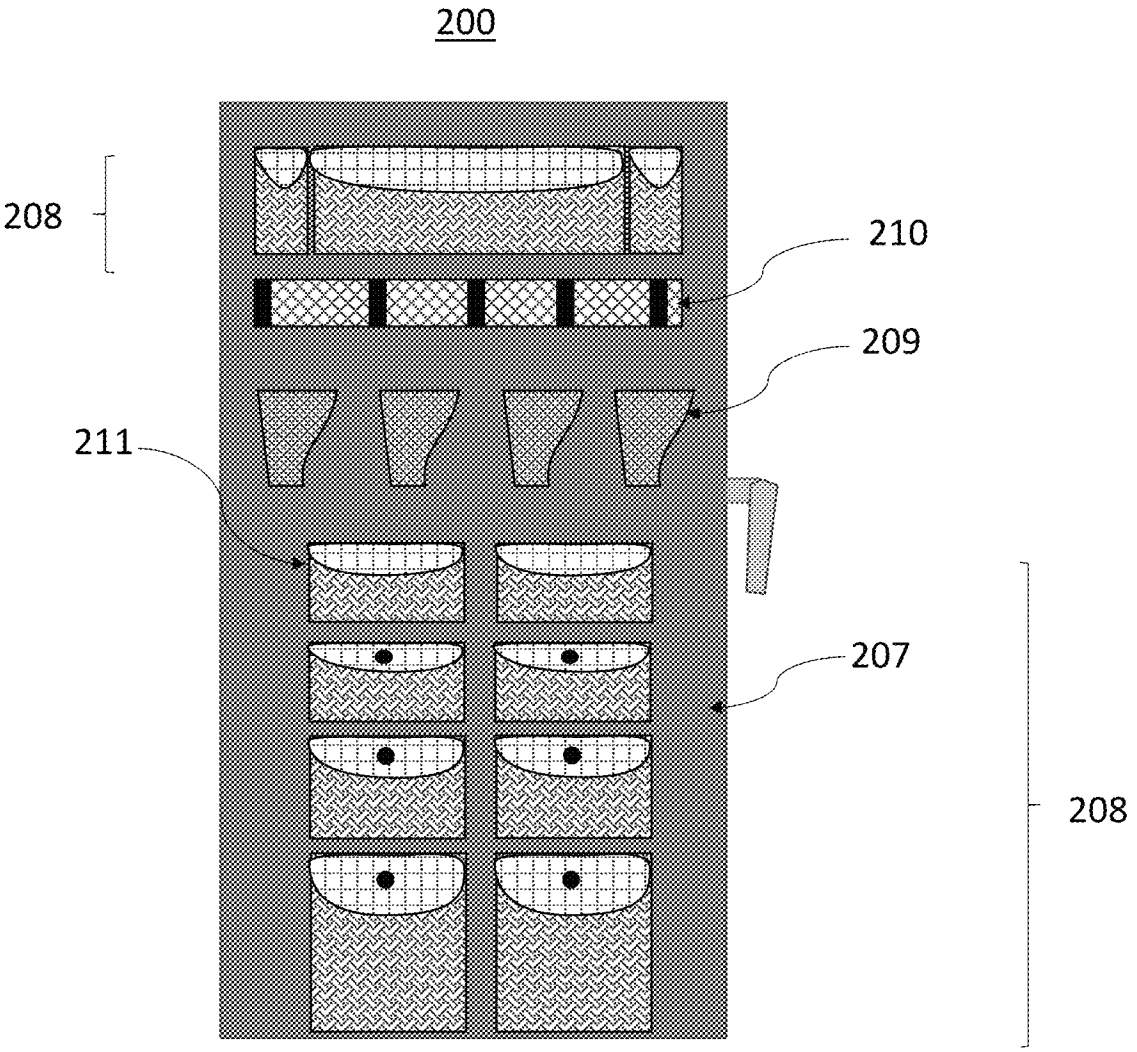
FIG. 2B is an illustrated view of an interior of a front door of the toy gun safe shown in FIG. 1.

Moving now to FIG. 2B, an illustrated view of the interior 207 of the front door 200 of the toy gun safe 100 is presented.

The interior 207 of the front door 200 has a plurality of storage pouches 208, a plurality of hand gun holsters 209 and accessory belt holder 210. The plurality of storage pouches 208 are useful for holding a variety of items such as bullets, BBs, nerf bullets, etc. The storage pouches 208 are a variety of sizes and are mixed and matched to fit the needs of the user. Each of the storage pouches 208 has a cover 211 for access to the items in the storage pouches 208.

At least one of the plurality of storage pouches 208 is removable and re-coupled to the interior 207 of the front door 200 by a coupling device 211. The coupling device 211 is preferably hooks, however other coupling devices such as Velcro® may be used as desired.

The hand gun holsters 209 are useful for holding toy guns such as nerf guns, water guns, water pistols, etc. The child is taught to pick up and store the toy guns and the other items in the proper place in the toy gun safe 100 when not using the toy guns and other items.

Figure 3:
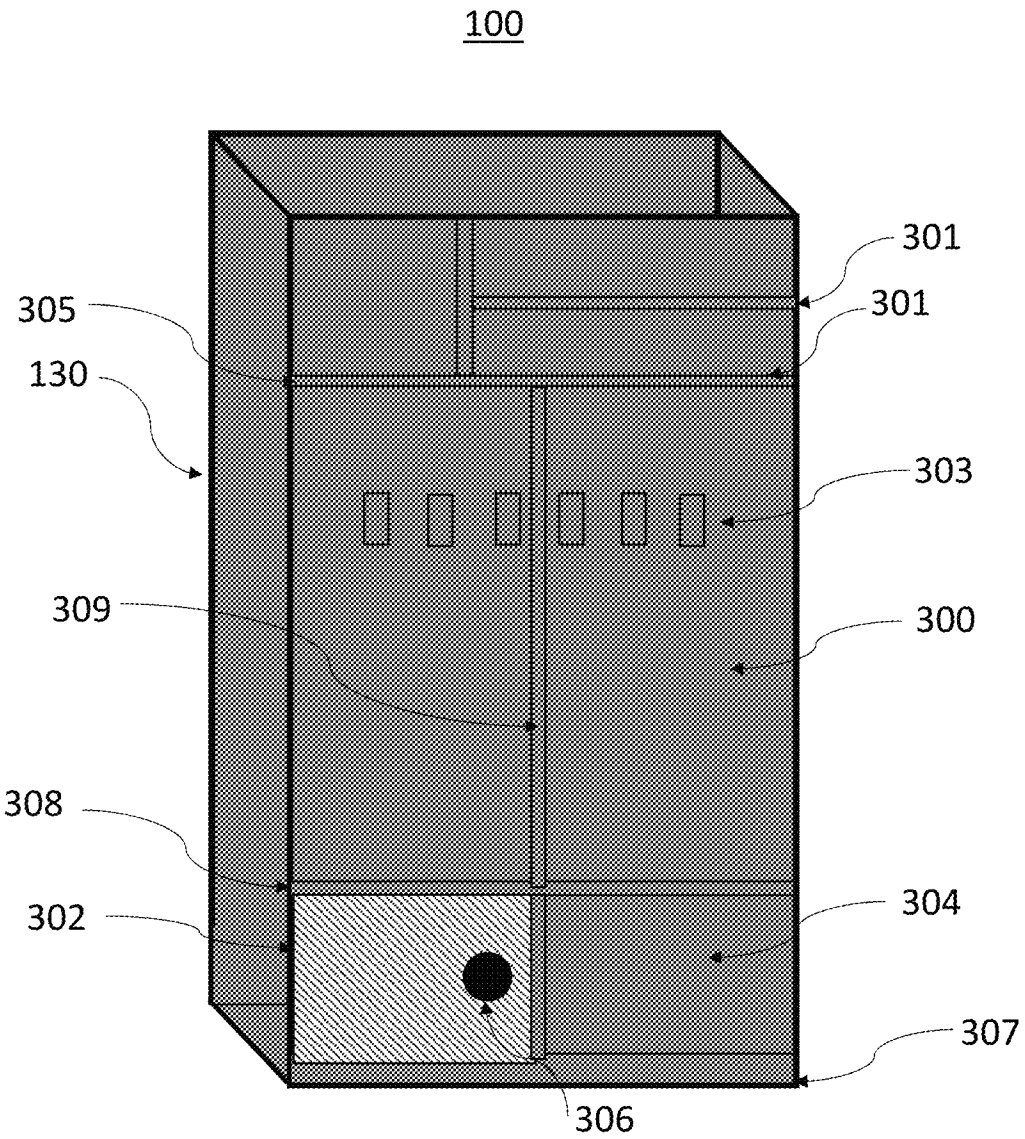
FIG. 3 is an illustrated view of an inside of the toy gun safe shown in FIG. 1.

Referring now to FIG. 3, an inside 300 of the toy gun safe 100 is presented.

The inside 300 of the toy gun safe 100 is preferably forty-eight (48) inches in height, however other heights are hereby contemplated, including, but not limited to, forty (40) inches, fifty-four (54) inches, etc. The inside 300 of the toy gun safe 100 preferably has a width of thirty-two (32) inches, however other widths are hereby contemplated, including, but not limited to, twenty-four (24) inches, thirty-six (36) inches, etc. The inside 300 of the toy gun safe 100 preferably has a depth of thirty-two (32) inches, however other depths are hereby contemplated, including, but not limited to, twenty-four (24) inches, thirty-six (36) inches, etc.

The inside 300 of the toy gun safe 100 has top shelves 301, a safe 302, a plurality of hooks 303 and a bottom shelf 304.

The plurality of hooks 303 are coupled to the back wall 130 of the toy gun safe 100. The hooks 303 are useful for hanging and storing of rifle like toy guns. The toy guns are coupled to the hooks 303 by snap-in hooks. These mimics the hanging of guns in a gun safe used for rifles and guns.

The bottom shelf 304 is coupled substantially near a bottom 307 of the inside 300 of the toy gun safe 100. The toy box area 304 is useful for a child to place and store other toys that the child that the child is properly taking care of.

The safe 302 is coupled to the first end 305 of the bottom shelf 304 and the bottom 307 of the inside 300 of the toy gun safe 100. The safe 302 has a handle 306 for opening and closing the safe 302. The handle 306 preferably has a locking mechanism. The locking mechanism allows for locking valuables and other items of value to the child away safely.

A separator 309 is coupled to the interior 300 of the toy gun safe 100. The separator 309 divides the toy gun safe 100 into a right side 310 and a left side 311.

Larger guns may be placed in the right side 310 of the interior 300 of the toy gun safe 100. Starter guns may be stored in the left side 310 of the interior 300 of the toy gun safe 100 above the safe 302.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A toy gun safe for teaching gun safety to children, the toy gun safe comprising:

a first side wall and a second side wall;

a plurality of first stickers, the first stickers being adheredly coupled to the first side wall and the second side wall;

a book of second stickers, the book of second stickers being removably coupled to the toy gun safe;

a front door, the front door having an exterior and an interior;

the exterior of the front door having a passcode box, a light and a handle;

the interior of the front door having a plurality of storage pouches, a plurality of hand gun holsters and an accessory belt;

an inside of the toy gun safe, the inside having a top shelf, a bottom shelf, a second safe, and a plurality of gun hooks, wherein the second safe being coupled to a first end of the bottom shelf of the toy gun safe, wherein the second safe being coupled to a bottom of the inside of the toy gun safe, and wherein the plurality of gun hooks being coupled to a back wall of the toy gun safe.

2. The toy gun safe of claim 1, wherein the toy gun safe being made of a hard-plastic material.

3. The toy gun safe of claim 1, wherein the toy gun safe having a height being forty-eight inches.

4. The toy gun safe of claim 1, wherein the toy gun safe having a depth being twenty-four inches.

5. The toy gun safe of claim 1, wherein the toy gun safe having a width being twenty-four inches.

6. The toy gun safe of claim 1, wherein the first stickers are gun safety rules.

7. The toy gun safe of claim 6, wherein the gun safety rules comprises one or more of the following printed indicia: Always keep your firearm pointed in a safe direction, Treat all firearms as if they are loaded, Keep your trigger finger outside of the guard and off of the trigger until you are ready to fire, Be certain of your target, your line of fire and what lies beyond the target.

8. The toy gun safe of claim 1, wherein the book of second stickers comprises one or more of: an animal sticker, zombie stickers, car stickers, flower stickers, an American flag sticker, a page of sayings including at least one of the following indicia: Battle, No Trespassing, Gun Safety, Handle with Care, Danger, Bulletproof, Fearless.

9. The toy gun safe of claim 1, wherein the light comprises light-emitting diode (LED) lamps.

10. The toy gun safe of claim 1, wherein the plurality of storage pouches having a variety of sizes.

11. The toy gun safe of claim 1, wherein the inside of the toy gun safe having a height being forty-eight inches.

12. The toy gun safe of claim 1, wherein the inside of the toy gun safe having a width being thirty-two inches.

13. The toy gun safe of claim 1, wherein the inside of the toy gun safe having a depth being thirty-two inches.

14. The toy gun safe of claim 1, wherein the second safe further comprising a second handle.

15. The toy gun safe of claim 14, wherein the second handle having a locking mechanism.

* * * * *